US006776630B1

(12) United States Patent
Huang

(10) Patent No.: US 6,776,630 B1
(45) Date of Patent: Aug. 17, 2004

(54) SAFETY SOCKET PROTECTIVE COVER

(75) Inventor: Chyong-Yen Huang, Taipei (TW)

(73) Assignee: Atom Technology Inc. (TW)

( * ) Notice: Subject to any disclaimer, the term of this patent is extended or adjusted under 35 U.S.C. 154(b) by 0 days.

(21) Appl. No.: 10/678,164

(22) Filed: Oct. 6, 2003

(51) Int. Cl.[7] ..... H01R 13/44
(52) U.S. Cl. ..... 439/137; 439/145
(58) Field of Search ..... 439/137, 145, 439/142, 136, 138, 139, 140, 141; 174/67

(56) References Cited

U.S. PATENT DOCUMENTS 4,040,698 A * 8/1977 Ortiz ..... 439/136
4,072,382 A * 2/1978 Reschke ..... 439/143
4,168,104 A * 9/1979 Buschow ..... 439/137
4,544,219 A * 10/1985 Barkas ..... 439/137
4,722,693 A * 2/1988 Rose ..... 439/137
4,867,694 A * 9/1989 Short ..... 439/137
5,069,630 A * 12/1991 Tseng et al. ..... 439/137
6,123,557 A * 9/2000 Wang et al. ..... 439/137
6,217,353 B1 * 4/2001 Yu-Tse ..... 439/145
6,537,089 B1 * 3/2003 Montague ..... 439/145

* cited by examiner

*Primary Examiner*—Alex Gilman

(57) ABSTRACT

A safety socket protective cover includes an outer housing, an inner housing, a sliding cover, an elastic support member and an elastic member. The sliding cover, the elastic support member and the elastic member are disposed at a gap between the outer housing and the inner housing. The sliding cover is provided with wedge members for corresponding with receptacles at the outer housing, wherein each wedge member has a passive inclined plane. The elastic support member has elastic restoring forces and is disposed below the sliding cover. The elastic member is pressed between the sliding cover and the outer housing. When the sliding cover receives abnormal forces, the wedge members block the receptacles at the outer housing due to unequal forces received, thereby preventing alien objects from entering the receptacles.

1 Claim, 8 Drawing Sheets

SAFETY SOCKET PROTECTIVE COVER

BACKGROUND OF THE INVENTION (a) Field of the Invention

The invention relates to a safety socket protective cover, and more particularly, to a safety socket protective cover offering dust-proof effects and capable of preventing accidental electric shocks caused by insertions of alien objects.

(b) Description of the Prior Art

A common wall socket or an extension wire socket is generally provided with at least one set of receptacles, wherein each set of receptacles has two or three receptacles. However, several drawbacks are found after studying the aforesaid prior socket. First of all, the "open" socket lacks protective measures, and accidental electric shocks are repeated occurrences among children caused by curiosity. Secondly, the prior socket is an open structure as described, with conductive straps at an interior thereof mostly being conductive materials such as copper. These conductive materials are often formed with aerugo resulted from humidity for being exposed in air over long periods of time, or accumulated with dust, and hence conductive efficiencies thereof become affected. Therefore, the prior socket has potential hazards to a certain degree, and can hardly be accounted as an ideal design when put to use.

SUMMARY OF THE INVENTION

The primary object of the invention is to provide a safety socket protective cover for preventing alien objects from entering receptacles of a socket. The structure according to the invention comprises an outer housing, an inner housing, a sliding cover, an elastic support member and an elastic member. The outer housing has receptacles for inserting pins of a plug. The inner housing is provided with conducting straps at an interior thereof, and inner receptacles at an upper side thereof for corresponding with the receptacles at the outer housing. Between the outer housing and the inner housing is a certain gap. The invention is characterized that, the gap between the outer housing and the inner housing is disposed with the sliding cover, the elastic support member and the elastic member; the sliding cover is provided with wedge members each having a passive inclined plane for corresponding with the receptacles at the outer housing, and a cover of each wedge members is formed with an opening; the elastic support member has elastic restoring forces and is pressed against a lower portion of the sliding cover, so as to provide the sliding cover with vertical restoring forces; the elastic member is disposed between the sliding cover and the outer housing to provide the sliding cover with horizontal restoring forces. Under normal circumstances, the sliding cover receives vertical and horizontal support from the elastic support member and the elastic member, respectively, such that the sliding cover is adhered to a lower edge of the outer housing, with the wedge members of the sliding cover extended into the receptacles at the outer housing. When an alien object is inserted into one of the receptacles, the sliding cover is slanted due to unequal forces received, such that the sliding cover is incapable of horizontal sliding movements to prevent the alien object from further inserting downward. When the sliding cover received equal forces, the sliding cover compresses the elastic support member, the wedge members are simultaneous disengaged from the receptacles, and the sliding cover is horizontally displaced due to horizontal thrust produced from forces received by the passive inclined planes.

DETAILED DESCRIPTION OF THE PREFERRED EMBODIMENTS

According to the invention, a socket is capable of keeping receptacles thereof blocked both under normal circumstances and when being inserted by an alien object. To better understand the invention, detailed descriptions of preferred embodiments shall be given with the accompanying drawings hereunder.

Figure 1:
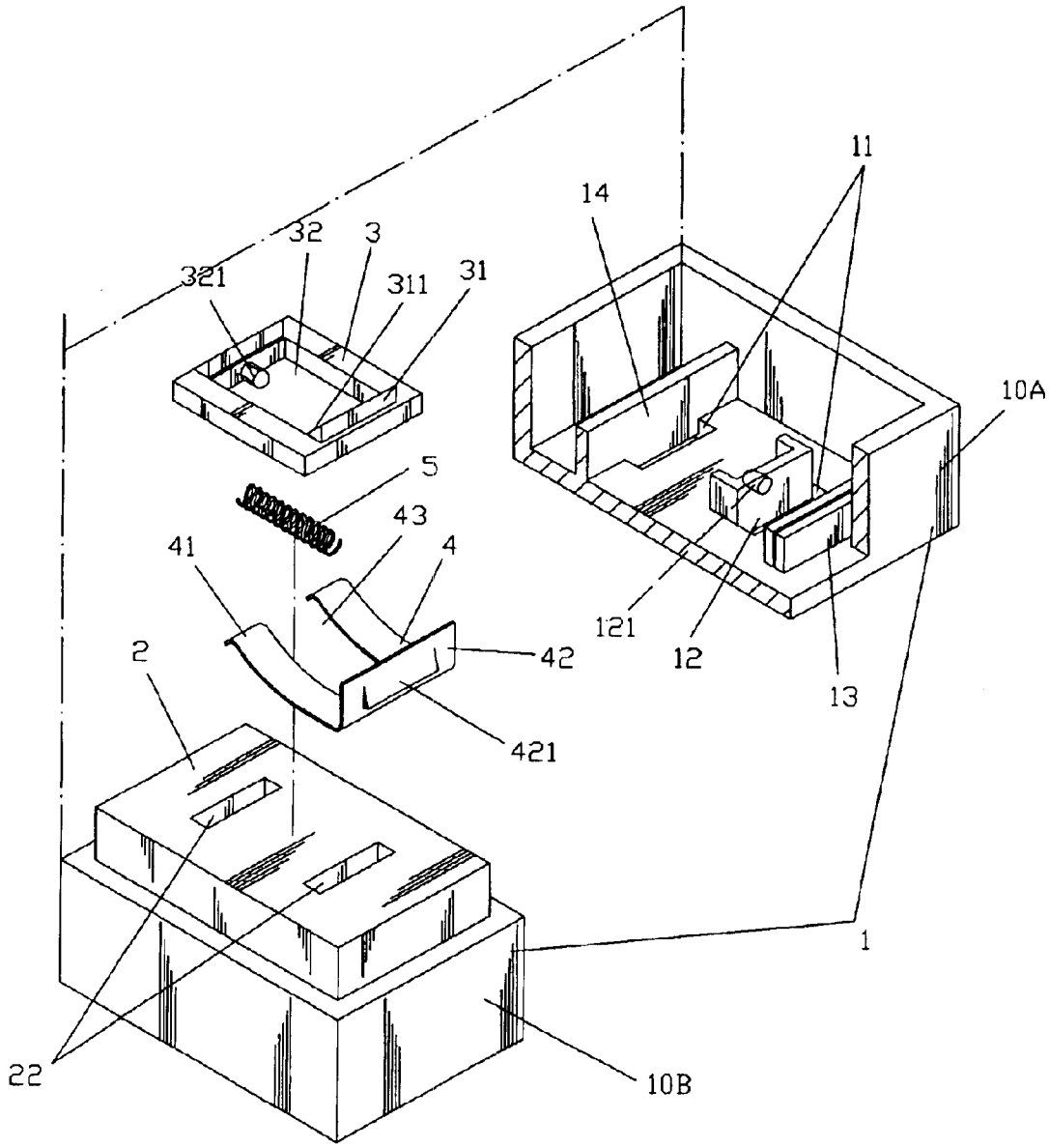
FIG. 1 shows an exploded elevational view of a first embodiment according to the invention.

Referring to FIG. 1 showing a first embodiment according to the invention, the present invention comprises an outer housing 1, an inner housing 2, a sliding cover 3, an elastic support element 4 and an elastic element 5.

The outer housing 1 is consisted of an upper cover section 10A and a lower cover section 10B. The outer housing 1 has receptacles 11 at an upper surface of the upper cover section 10A. The upper cover section 10A is formed with a locating seat 12, an embedding member 13 and a blocking member 14 at a lower plane thereof, wherein the locating seat 12 has a column 121 at an interior thereof in a protruding manner.

Figure 2:
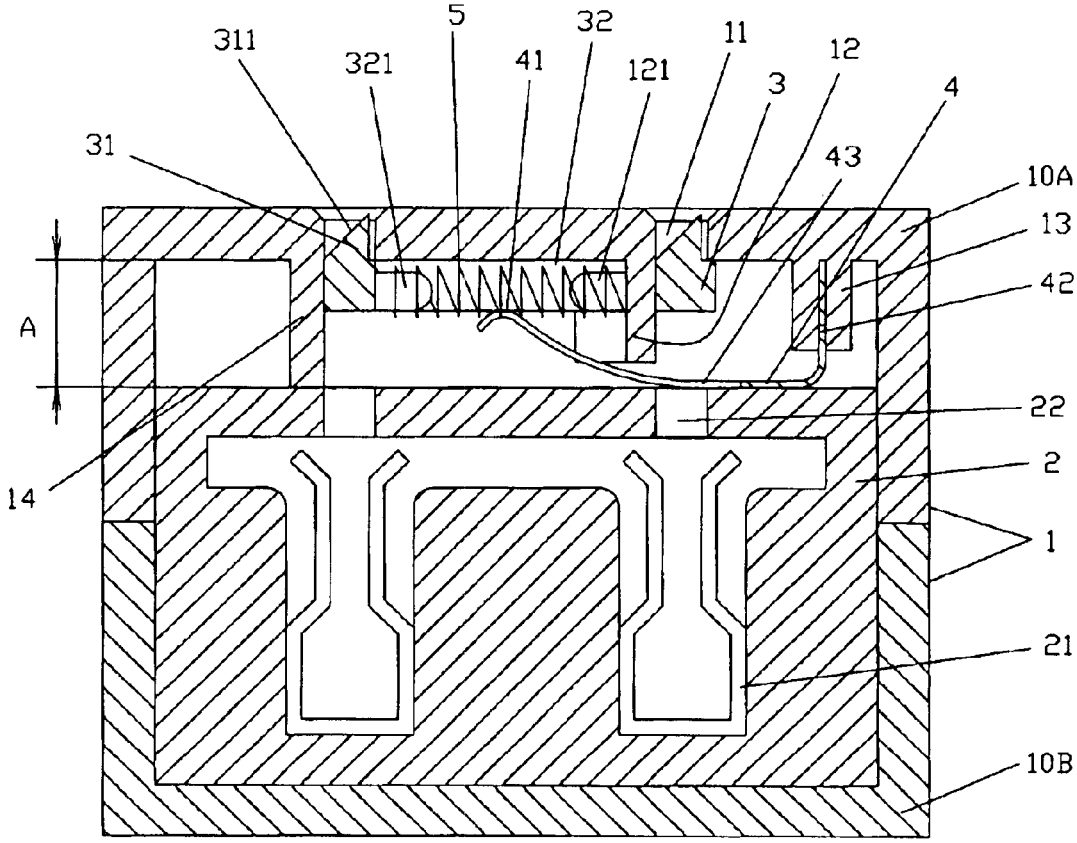
FIG. 2 shows a sectional view of a first embodiment according to the invention.

Referring to FIG. 2, the inner housing 2 has conducting straps 21 at an interior thereof, and an upper surface of the inner housing 2 is provided with inner receptacles 22 for corresponding with the receptacles 11 at the outer housing 1.

For corresponding with the receptacles 11 at the upper cover section 10A, the sliding cover 3 is disposed with wedge members 31 each having a passive inclined plane 311. The sliding cover 3 is further formed with an opening 32 between the wedge members 31, and a column 321 is provided within the opening 32.

The elastic support member 4 is a curved metal plate. One end of the elastic support member 4 is arched to form a stopping wall 41, and the other end is vertically bent to form a vertical section 42 further forming a wedge plate 421 by extending upward in a slanting manner. The elastic support member 4 also has an aperture 43.

The elastic member 5 is a spring in this embodiment.

Referring to FIG. 2 showing assembly of the invention, the inner housing 2 is placed in the outer housing 1. Between the inner housing 2 and the upper cover section 10A of the outer housing 1 is a gap A for accommodating the sliding cover 3, the elastic support member 4 and the elastic member 5. The inner receptacles 22 at the inner housing 2 are aligned with the receptacles 11 at the outer housing 1, and the vertical section 42 of the elastic support member 4 is embedded into the embedding member 13 of the outer housing 1, such that the wedge plate 421 is closely butted to fix the elastic support member 4 at the upper cover section 10A of the outer housing 1. The sliding cover 3 is rested against the stopping wall 41 of the elastic support member 4. The elastic member 5 has one end thereof placed around the column 321 at the sliding cover 3, and the other end thereof placed around the column 121 in the locating seat 12, so that the opening 32 of the sliding cover 3 is sustained and located using the locating seat 12 to further guide the sliding cover 3 for displacements. In addition, the sliding cover 3 is capable of vertical elevations using support provided by the elastic support member 4, while also being provided with horizontal restoring forces from horizontal support by the elastic member 5. After having assembled the structure, the sliding cover 3 is adhered at a lower surface of the upper cover section 10A of the outer housing 1, and the wedge members 31 at the receptacles 11 at the upper cover section 10A of the outer housing 1, so as to block the receptacles 11 to provided safety and protection effects.

Figure 3:
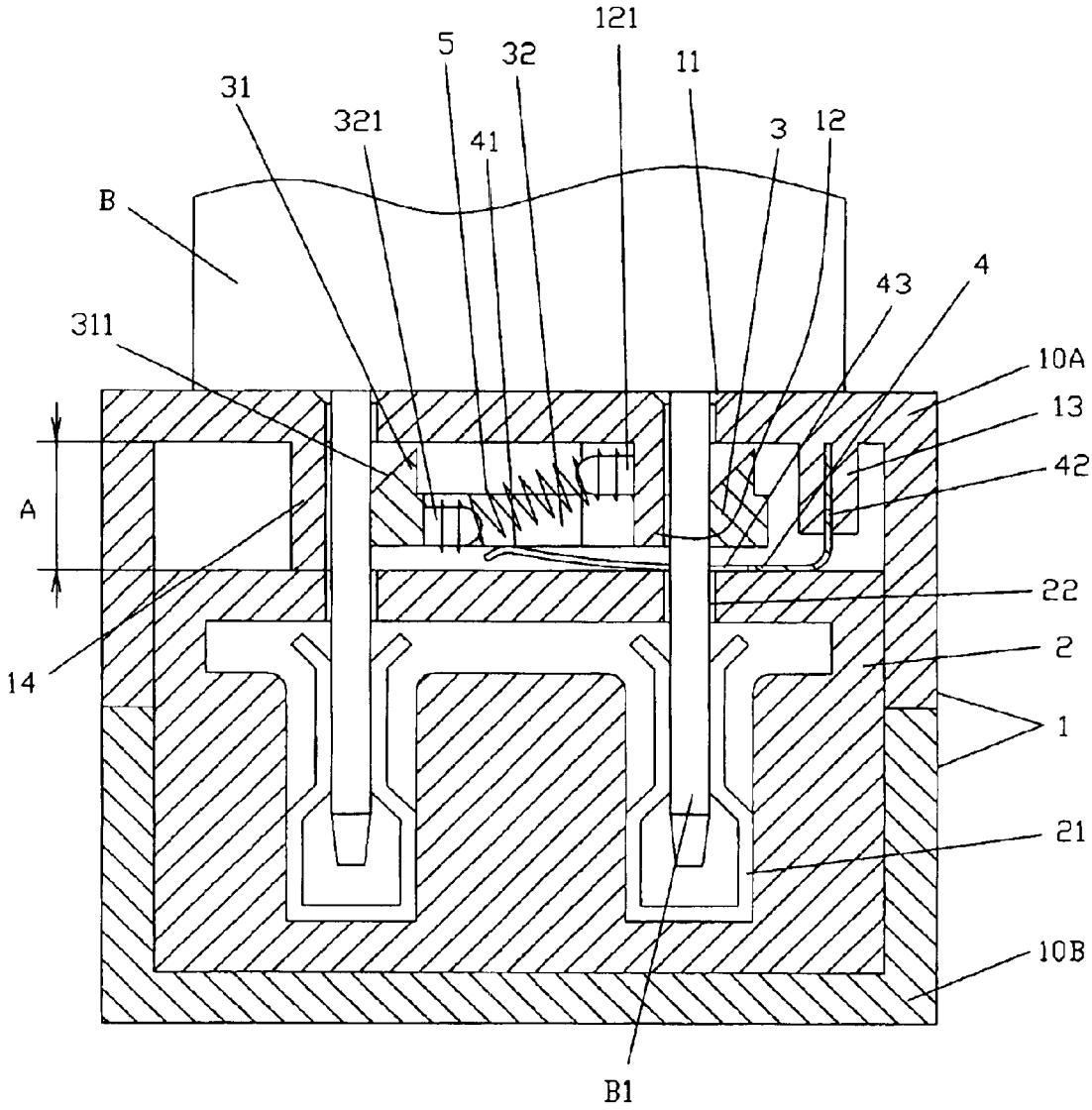
FIG. 3 shows a schematic view illustrating normal insertion motions of a first embodiment according to the invention.

Referring to FIG. 3, when the embodiment is being inserted under normal circumstances, pins B1 of a plug B are levelly inserted in a downward direction into the receptacles 11 at the outer housing 1. That is, with equal forces, end portions of the two pins B1 are pressed against the passive inclined planes 311 of the wedge members 31 at the sliding cover 3. Through the vertical forces downwardly applied by the pins B1, the sliding cover 3 moves downward and become disengaged from the receptacles 11. When the pins B1 continue to apply downward forces, actions imposed upon the passive inclined planes 311 of the wedge members 31 produce horizontal thrust that horizontally displaces the sliding cover 3 to compress the elastic member 5. Meanwhile, the elastic support member 4 is also pressed by the downward forces and is deformed for producing restoring elasticity. When the pins B1 continue to further apply downward forces, the pins B1 pass through sides of the wedge members 31 at the sliding cover 3, and directly penetrate into the inner receptacles 22 at the inner housing 2 to come into contact with the conducting straps 21 therein. When the plug B is withdrawn, the sliding cover 3 restores to an original position owing to restoring elasticity provided by the elastic support member 4 and the elastic member 5. During repositioning of the sliding cover 3, the blocking member 14 at the outer housing 1 forms a retaining mechanism relative to the sliding cover 3, such that the wedge members 31 are appropriately re-wedged into the receptacles 11 at the outer housing 1 as shown in FIG. 2.

Figure 4:
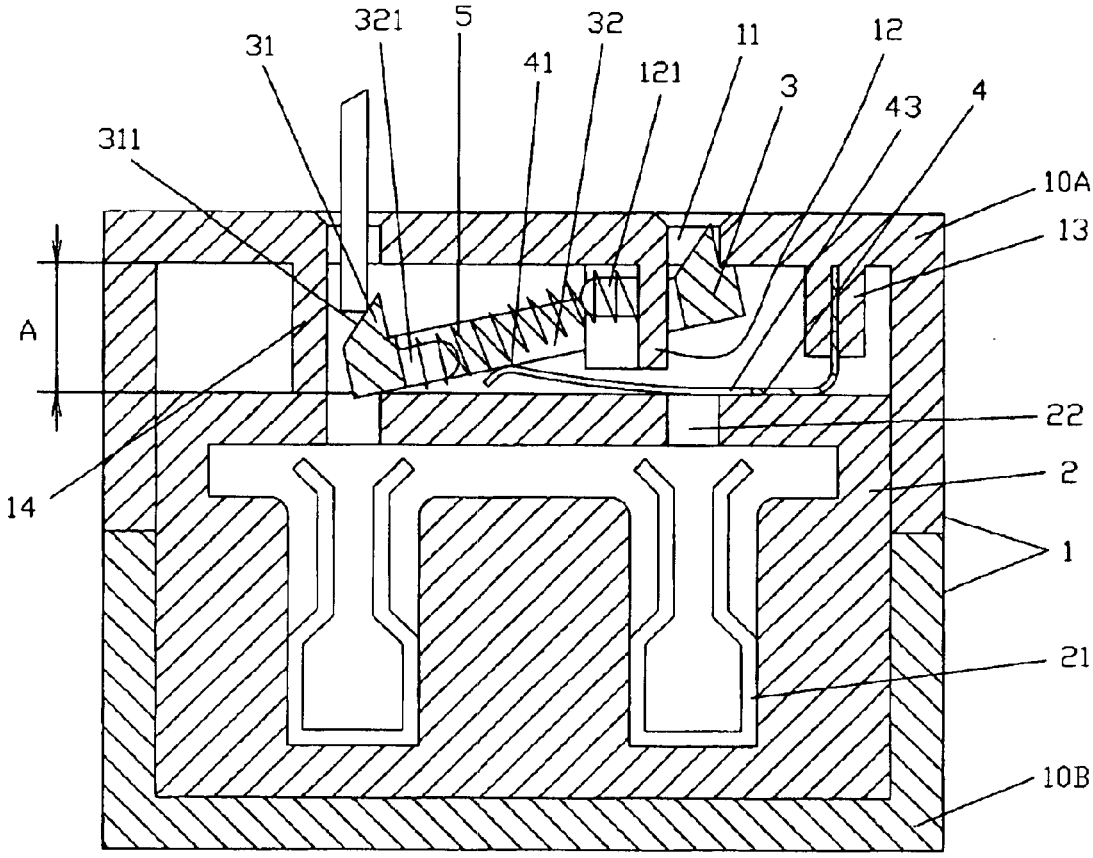
FIG. 4 shows a schematic view illustrating motions of a first embodiment according to the invention being inserted by an alien object.

Referring to FIG. 4, when an alien object is inserted into one of the receptacles 11 at the outer housing 1 (in this embodiment, the alien object is inserted into a left receptacle 11), external forces applied come into contact with the pushed wedge member 311 of the sliding member 3. However, due to support given by the elastic support member 4 below the sliding cover 3 and an elastic fulcrum formed by the stopping wall 41 at a lower portion of the sliding cover 3, the sliding cover 3 performs swinging movements relative to a fulcrum formed by the elastic support member 4 below when having received forces only at one side thereof. As a result, the wedge member 31 at the sliding cover 3 not being pushed still locates in the receptacle 11 that is not being inserted by the alien object. The sliding cover 3 then fails horizontal sliding movements and remains shielding the inner receptacle 22, thereby accomplishing safety and protection effects.

Figure 5:
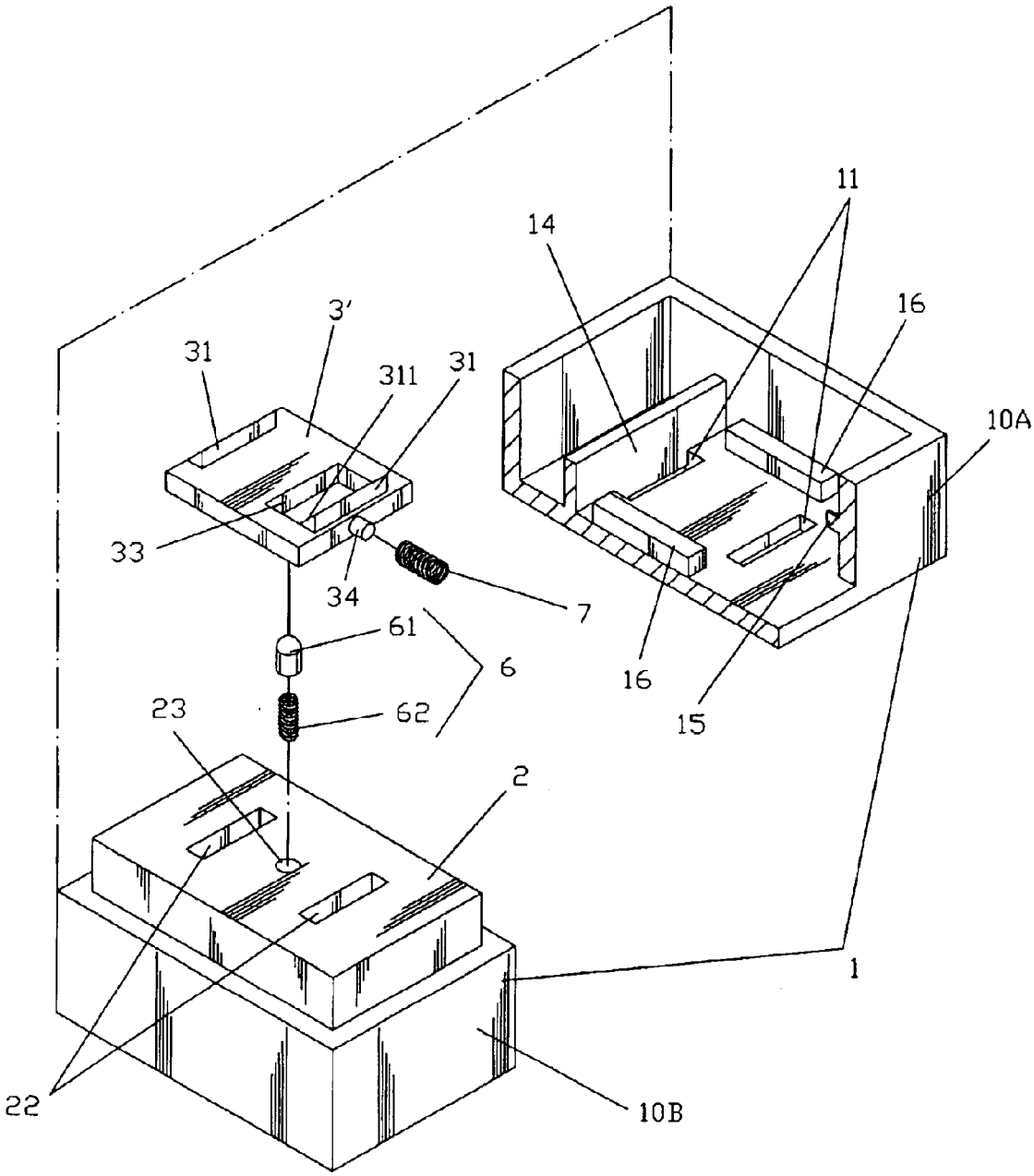
FIG. 5 shows an exploded elevational view of a second embodiment according to the invention.
Figure 6:
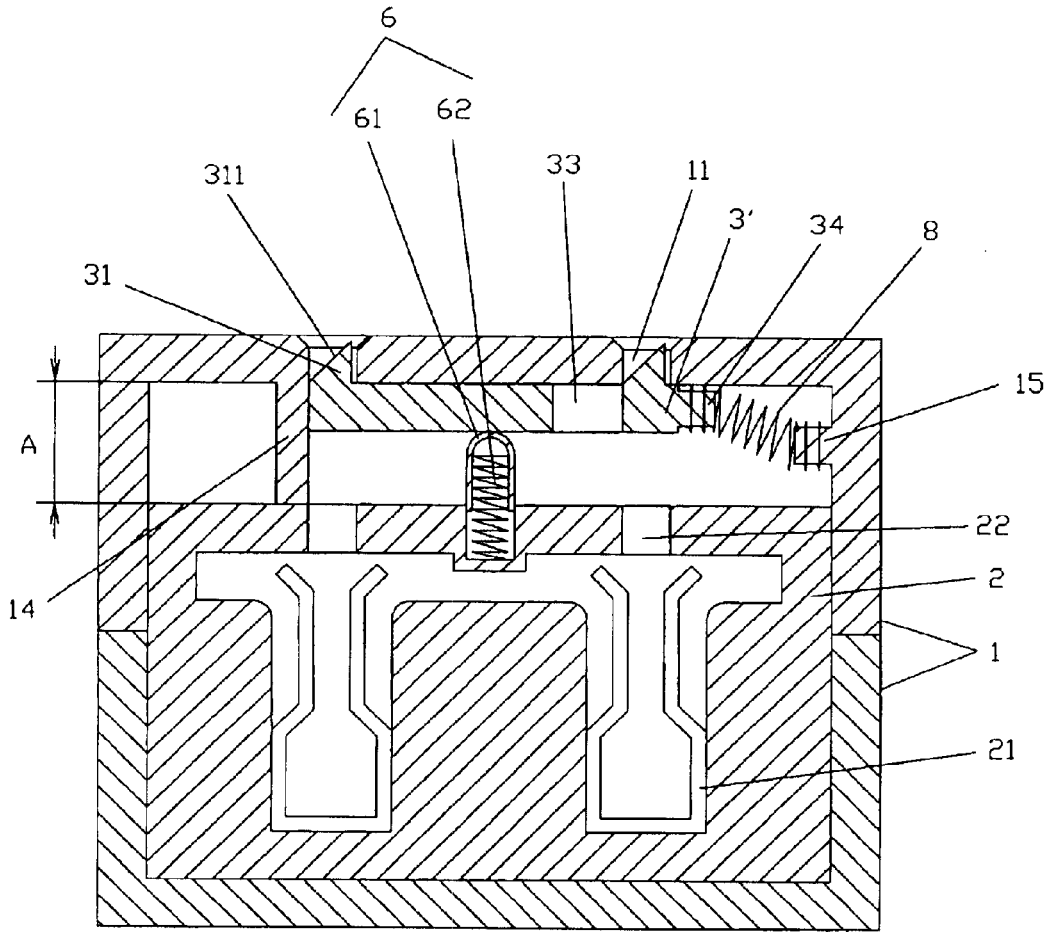
FIG. 6 shows a sectional view of a second embodiment according to the invention.
Figure 7:
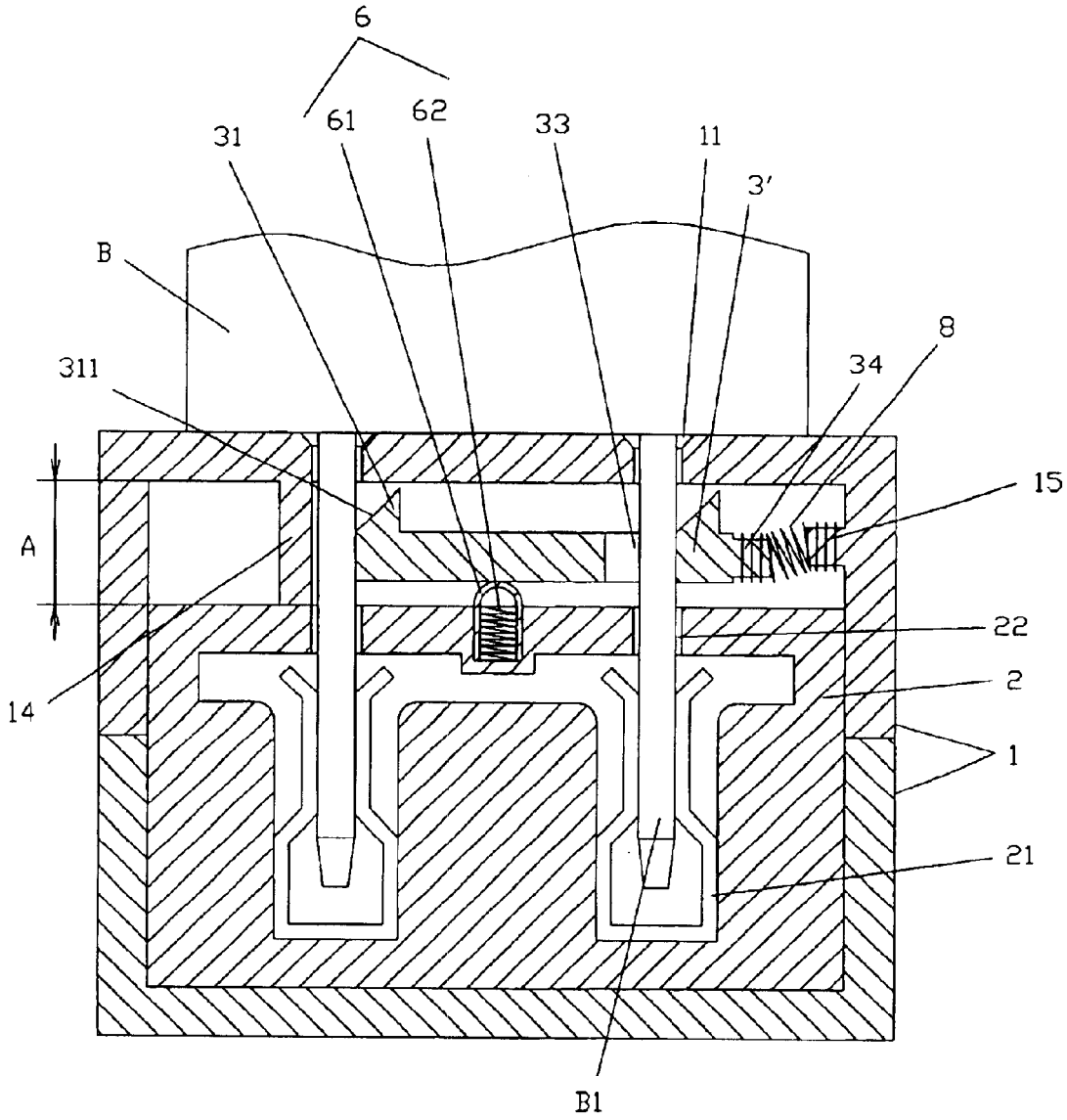
FIG. 7 shows a schematic view illustrating normal insertion motions of a second embodiment according to the invention.

Referring to FIG. 5 showing a second embodiment according to the invention, the invention similarly comprises an outer housing 1, an inner housing 2, a sliding cover 3', an elastic support member 6 and an elastic member 7. Referring to FIG. 6, apart from conducting straps 21 and receptacles 22, the inner housing 2 is additionally provided with an accommodating orifice 23. The sliding cover 3' is formed with an opening 33, and wedge members 31 for corresponding with receptacles 11 at the outer housing 1, wherein the each wedge member 31 has a passive inclined plane 311. The sliding cover 3' is further formed with a stopping pillar 34 at one side of. For corresponding with the stopping pillar 34, the outer housing 1 is disposed with a pillar 15 in a protruding manner at an inner surface thereof. The outer housing 1 also has two stopping walls at two sides thereof for corresponding with a width of the sliding cover 3. In this embodiment, the elastic support member 6 is consisted of a sheath 61 and a spring 62, and the elastic member 7 is a spring.

Referring to FIG. 6 showing assembly of this embodiment according to the invention, the sliding cover 3' is vertically supported by the elastic support member 6 and horizontally pushed by the elastic member 7, and thus shields the receptacles 11 by adhering to a lower portion of the outer housing 1.

Referring to FIG. 6, once pins B1 of a plug B are inserted, the sliding cover 3 moves downward from equal forces received. At the same time, actions imposed upon the passive inclined planes 311 of the wedge members 31 by the pins B1 produce horizontal thrust that horizontally displaces the sliding cover 3. Next, the elastic support member 6 and the elastic member 7 are both compressed to produce restoring elasticity. After horizontal movements of the sliding cover 3', the pins B1 of the plug B are passed through the sliding cover 3' to come into contact with conducting straps 21 in the inner housing 2.

Figure 8:
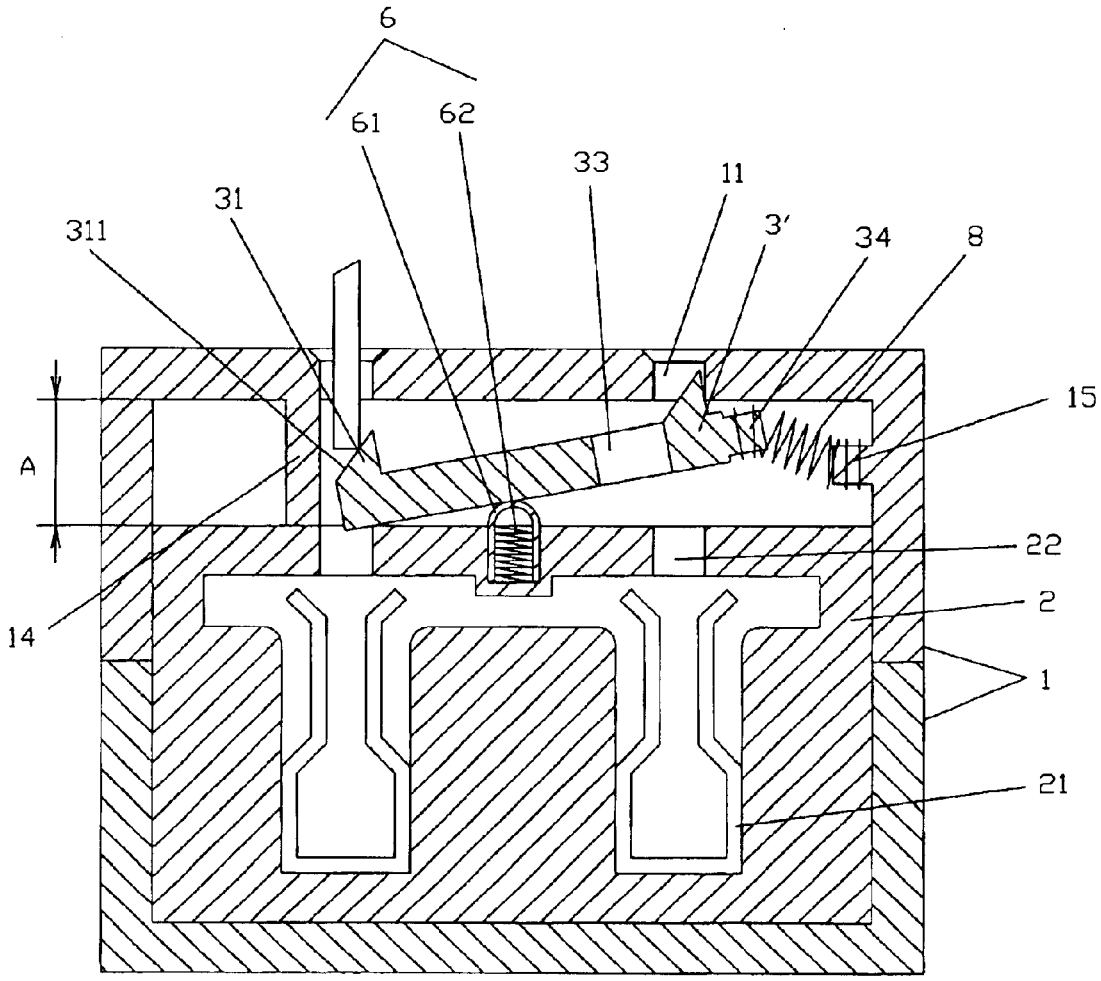
FIG. 8 shows a schematic view illustrating motions of a second embodiment according to the invention being inserted by an alien object.

Referring to FIG. 8 showing the invention being inserted by an alien object, due to unequal forces received, the sliding cover 3' is slanted relative to a fulcrum formed by a top end of the sheath 61 of the elastic support member 6. At this point, the wedge member 31 at the sliding cover 3' not receiving external forces is still located in the other receptacle 11 not being inserted. Consequently, the sliding cover 3 is incapable of horizontal movements, and the alien object fails to pass through the sliding cover 3'.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A safety socket protective cover comprising an outer housing, an inner housing, a sliding cover, an elastic support member and an elastic member; wherein:

the outer housing has receptacles for inserting pins of a plug; the inner housing is provided with conducting straps at an interior thereof, and inner receptacles at an upper side thereof for corresponding with the receptacles at the outer housing; and between the outer housing and the inner housing is a certain gap; and the characteristics being that, the gap between the outer housing and the inner housing is disposed with the sliding cover, the elastic support member and the elastic member; and the sliding cover is provided with wedge members each having a passive inclined plane for corresponding with the receptacles at the outer housing;

the elastic support member is butted against a lower portion of the sliding cover to form a fulcrum of the sliding cover, and provides the sliding cover with vertical restoring forces;

the elastic member is disposed between the sliding cover and the outer housing to provide the sliding cover with horizontal restoring forces;

the sliding cover receives vertical and horizontal support from the elastic support member and the elastic member, such that the sliding cover is adhered to a lower edge of the outer housing, with the wedge members of the sliding cover extended into the receptacles at the outer housing; when an alien object is inserted into one of the receptacles, the sliding cover is slanted due to the fulcrum formed by the elastic support member, such that the other wedge member of the sliding member remains blocked in the receptacle at the outer housing to prevent the sliding cover from horizontal sliding movements; and when the sliding cover receives equal forces, the sliding cover compresses the elastic support member, the wedge members are simultaneously disengaged from the receptacles, and the sliding cover is horizontally displaced due to horizontal thrust produced from forces received by the passive inclined planes.

* * * * *